US010040305B2

(12) United States Patent
Faber

(10) Patent No.: US 10,040,305 B2
(45) Date of Patent: Aug. 7, 2018

(54) PLATE CARRIER HAVING A GRID PATTERN FOR A SELF-INKING STAMP AND PRODUCTION METHOD

(71) Applicant: COLOP STEMPELERZEUGUNG SKOPEK GESELLSCHAFT M.B.H & CO. KG., Wels (AT)

(72) Inventor: Ernst Faber, Wels (AT)

(73) Assignee: COLOP STEMPELERZEUGUNG SKOPEK GESELLSCHAFT M.B.H. & CO. KG., Wels (AT)

( * ) Notice: Subject to any disclaimer, the term of this patent is extended or adjusted under 35 U.S.C. 154(b) by 1 day.

(21) Appl. No.: 14/786,037

(22) PCT Filed: Apr. 22, 2014

(86) PCT No.: PCT/AT2014/050098

§ 371 (c)(1),
(2) Date: Oct. 21, 2015

(87) PCT Pub. No.: WO2014/172738

PCT Pub. Date: Oct. 30, 2014

(65) Prior Publication Data

US 2016/0067993 A1 Mar. 10, 2016

(30) Foreign Application Priority Data

Apr. 22, 2013 (AT) ..... A 50272/2013

(51) Int. Cl.
*B41K 1/06* (2006.01)
*B41K 1/20* (2006.01)
(Continued)

(52) U.S. Cl.
CPC ..... *B41K 1/36* (2013.01); *B41K 1/02* (2013.01); *B41K 1/06* (2013.01); *B41K 1/38* (2013.01); *B41K 1/40* (2013.01)

(58) Field of Classification Search
CPC ... B41K 1/02; B41K 1/06; B41K 1/38; B41K 1/40
(Continued)

(56) References Cited

U.S. PATENT DOCUMENTS 3,096,713 A * 7/1963 McLaughlin, Jr. ..... B41K 1/02 101/103
3,119,330 A * 1/1964 Kunetka ..... B41F 27/1275 101/376
(Continued)

FOREIGN PATENT DOCUMENTS

AT 006 470 U1 11/2003
AT 007 860 U1 10/2005
(Continued)

OTHER PUBLICATIONS

International Search Report of PCT/AT2014/050098, dated Aug. 4, 2014.
(Continued)

*Primary Examiner* — Leslie J Evanisko
(74) *Attorney, Agent, or Firm* — Collard & Rose, P.C.

(57) ABSTRACT

A plate carrier (1) for a self-inking stamp (5) and a method for producing a plate carrier (1) having an adhesive surface (9) for attaching a text plate (14) to a printing side (2) of the plate carrier (1), the plate carrier (1) having, on the printing side (2), a grid pattern (13) aligned in relation to the edges (3, 6, 7) of the plate carrier (1) for aligning the text plate (14) when attaching it to the plate carrier (1).

8 Claims, 3 Drawing Sheets

Figure 1B:
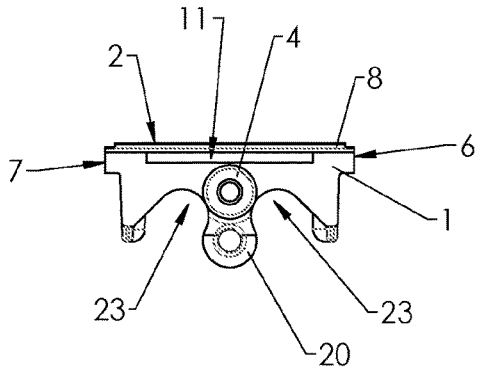

(51) Int. Cl.

| | |
|---|---|
| ***B41K 1/36*** | (2006.01) |
| ***B41K 1/02*** | (2006.01) |
| ***B41K 1/38*** | (2006.01) |
| ***B41K 1/40*** | (2006.01) |

(58) Field of Classification Search
USPC ..... 101/327, 333, 368, 395, 103, 109, 370, 101/371, 372, 373, 486, DIG. 36
See application file for complete search history.

(56) References Cited

U.S. PATENT DOCUMENTS

| | | | | |
|---|---|---|---|---|
| 4,586,714 | A * | 5/1986 | Lenkoff | A63F 9/10 156/249 |
| 4,996,735 | A * | 3/1991 | Blankenship | A46B 7/04 101/373 |
| 5,313,885 | A | 5/1994 | Winston | |
| 6,708,614 | B2 | 3/2004 | Lookholder et al. | |
| 6,920,825 | B1 * | 7/2005 | Baxter | B41K 1/04 101/327 |
| 6,931,990 | B2 * | 8/2005 | Wei | B41K 1/40 101/104 |
| 7,652,225 | B2 | 1/2010 | Fazeny | |
| 8,002,114 | B2 | 8/2011 | Faber | |
| 2005/0241507 | A1 | 11/2005 | Waters | |
| 2006/0185539 | A1 | 8/2006 | Faber | |
| 2007/0144366 | A1 * | 6/2007 | Ogino | B41K 1/02 101/109 |
| 2010/0300314 | A1 * | 12/2010 | Chen | B41K 1/56 101/405 |

FOREIGN PATENT DOCUMENTS

| | | | |
|---|---|---|---|
| AT | 507 692 | A1 | 7/2010 |
| CN | 201169123 | Y | 12/2008 |
| CN | 201471866 | U | 5/2010 |
| DE | 1 273 542 | B | 7/1968 |
| DE | 24 06 261 | A1 | 8/1975 |
| DE | 26 06 642 | A1 | 8/1977 |
| DE | 32 00 551 | A1 | 7/1983 |
| DE | 42 00 267 | A1 | 7/1993 |
| DE | 44 07 287 | A1 | 9/1995 |
| DE | 10 2006 025 534 | A1 | 12/2006 |
| EP | 1 603 754 | B1 | 8/2007 |
| WO | 2004/085110 | A1 | 10/2004 |

OTHER PUBLICATIONS

VISTAPRINT, Instructions for Assembling the Stamps [Online], [discovered on Apr. 17, 2014]. Discovered on website: <URL:http://www.vistaprint.de/stempel-montage-anleitung.aspex?GP . . . >.
Austrian Search Report in A 50272/2013, dated Apr. 17, 2014.
Austrian Office Action in A 50272/2013-1, dated Apr. 17, 2014.
Letter of Austrian Patent Attorney to the EPO in PCT/AT2014/050098, dated Dec. 10, 2014, with English translation of relevant parts.
Letter of Austrian Patent Attorney to the EPO in PCT/AT2014/050098, dated Jun. 3, 2015, with English translation of relevant parts.
First Chinese Office Action in Chinese Application No. 201480029862.5 dated Oct. 9, 2016 with English translation.
European Office Action in European Application No. 14 723 685.5-1704 dated Sep. 12, 2017 with English translation of relevant parts.

* cited by examiner

PLATE CARRIER HAVING A GRID PATTERN FOR A SELF-INKING STAMP AND PRODUCTION METHOD

CROSS REFERENCE TO RELATED APPLICATIONS

This application is the National Stage of PCT/AT2014/050098 filed on Apr. 22, 2014, which claims priority under 35 U.S.C. § 119 of Austrian Application No. A 50272/2013 filed on Apr. 22, 2013, the disclosures of which are incorporated by reference. The international application under PCT article 21(2) was not published in English.

The invention relates to a plate carrier for a self-inking stamp, and to a method for producing a plate carrier, having an adhesive surface for attaching a text plate to a printing side of the plate carrier.

In order to enable an economic production of stamps and stamp devices and/or a mass production of same, it is known to produce them without a stamp plate and/or text plate and to connect the text plate with the printing plate subsequently with a stamp plate carrier (in the following shortly referred to as plate carrier) provided in or at the stamp. The connection between the text plate and the plate carrier may be an adhesive connection, and the individual text plate is usually connected manually with the plate carrier. The alignment of the text plate on the plate carrier is performed by hand and roughly by eye. In particular, a twisting of the text plate and/or a poorly centered arrangement may result, so that later e.g. sloping prints and/or an aggravation of the pressure distribution on the text plate and hence a worse print design ensue. However, once the text plate has been used and the error is noticed, a correction of the alignment is not provided for and is usually not possible, or only possible with much effort. When here and in the following a text plate is usually referred to for the sake of simplicity, this means quite generally a stamp plate with any kind of printing plate contents, in particular also those with graphic and/or written elements.

DE 32 00 551 A1, for instance, illustrates a stamp with an exchangeable plate carrier. The stamp or printing plate is connected with the plate carrier by attaching or similar measures. It is, however, not described in detail how this connection is performed.

A self-inking stamp in which the plate carrier is—as usual—already installed during production is illustrated by EP 1 603 754 B1. A later exchange of the plate carrier is provided for in exceptional cases only. Accordingly, a correct alignment of a text plate to be applied on the plate carrier prior to the first use is all the more important.

It is therefore an object of the invention to provide a plate carrier which facilitates an optimum alignment of the text plate relative to the plate carrier when a text plate is applied and/or attached to an adhesive surface. The invention is intended to be usable irrespective of the dimensions and the shape of the text plate. In particular, the alignment ("top"/"bottom") is to be facilitated when attaching text plates with dimensions comparable to those of the plate carrier, i.e. which largely cover the plate carrier, but also with a shape deviating from a rectangle, which is, however, unknown when the plate carrier is produced. Moreover, the invention is to improve, apart from the alignment, also the horizontal and vertical centering of the text plate on the plate carrier during attaching, so that a printing as symmetrical and uniform as possible can be achieved when the stamp is used.

In accordance with the invention this object is solved in that the plate carrier comprises, on the printing side, a grid pattern aligned in relation to the edges of the plate carrier for aligning the text plate when attaching it to the plate carrier. For easy centering the grid pattern preferably comprises elements which are each mirror-symmetrical in relation to a horizontal and/or vertical central axis, wherein the central axes divide the printing side of the plate carrier into two respective halves of equal size, i.e. into four quarters altogether. The grid pattern may, for instance, comprise horizontal and vertical markings which are preferably arranged in symmetrical distances in relation to the central axes. In the case of a rectangular plate carrier the grid pattern may consist of markings which are each parallel to the lateral edges of the plate carrier. The markings may, for instance, be continuous or dashed lines, crosses, points, or the like. In order that an individual text plate, the maximum dimensions of which corresponds roughly to the dimensions of the plate carrier, can be aligned and centered, markings in the edge region, i.e. between the edge of the plate carrier and the center of the plate carrier, in particular closer to the edge than to the center, are useful.

In the corresponding method of the initially mentioned kind, the object according to the invention is solved in that the grid pattern is produced on the plate carrier. This makes it possible to ensure the alignment of the grid pattern already during production, and no further—naturally error-prone—alignment processes are necessary later on. Since the production of the grid pattern is a process which is exactly reproducible also with respect to the alignment, it is not necessary in the method according to the invention to detect the alignment of the grid pattern, but it is sufficient to guarantee the alignment of the plate carrier prior to the production of the grid pattern.

With respect to the plate carrier it has moreover turned out to be favorable if the grid pattern comprises an orientation element for marking a preferred orientation. The orientation element thus interrupts possible mirror symmetries of the grid pattern and is helpful exactly in the case of plate carriers which are otherwise mirror-symmetrical (e.g. rectangular). Usually, for instance, in the case of text stamps the preferred orientation is matched with the arrangements of text elements on the text plate. The preferred orientation indicated by the orientation element can be recognized by a user of the stamp, for instance, from the shape of the stamp and/or possible further identifications on a stamp housing or a stamp handle after the orientation element was covered with a text plate.

If the grid pattern is arranged directly on a one-piece plate carrier, the adhesive surface may be formed by a transparent double-sided adhesive film arranged on the plate carrier and over the grid pattern. The grid pattern arranged under the adhesive film and/or between the adhesive film and the plate carrier is thus visible through the adhesive film. This arrangement has the advantage that a displacing of the adhesive film on the pate carrier cannot impair the alignment of the grid pattern. If necessary, the adhesive film can even be exchanged and be replaced, for instance, by a new transparent double-sided adhesive film without aggravating the alignment of the grid pattern in relation to the plate carrier.

In the method according to the invention it is therefore of advantage to connect a transparent double-sided adhesive film, after the production of the grid pattern on the printing side of the plate carrier, with the printing side of the plate carrier. Neither the exact cut of the film nor the exact alignment thereof is of substantial importance.

Alternatively, the adhesive surface may also be formed by a double-sided adhesive film formed on the plate carrier, wherein the grid pattern is arranged on the double-sided adhesive film. In this case a non-transparent double-sided adhesive film may also be used.

Accordingly, in the method according to the invention the grid pattern may also be produced on a double-sided adhesive film which is already connected with the plate carrier. Also in this case an exact alignment of the film during attaching need not be observed, and possible misalignments of the film have no negative influence on the alignment of the grid pattern on the plate carrier and/or finally the text plate on the plate carrier. Such misalignments may otherwise occur both already during the cutting of large-area printed films to the dimensions of the plate carrier and during the alignment of the cut film prior to attaching it to the plate carrier.

The grid pattern may preferably be produced with a laser, in particular a Nd:YAG laser, on plate carriers of usual materials. Such laser marking is particularly well reproducible and can thus be performed extremely precisely and moreover very quickly. Moreover, this method has the advantage that it can be adapted to different plate carriers, i.e. to plate carriers of different sizes and shapes, in an easy manner and without material costs. The wavelength of the laser is preferably adapted to the material of the plate carrier and/or to that of the double-sided adhesive film, if the latter is marked. Polyoxymethylene (POM) or acrylonitrile-butadiene-styrene copolymer (ABS) may be used, for instance, as a material of the plate carrier. Preferably, the wavelength is chosen such that a color change is achieved with the given material. Alternatively, however, engraving or some other shaping process may also be used. With the afore-mentioned materials (POM and ABS) color change can, for instance, be achieved with a Nd:YAG laser—in contrast to a $CO_2$ laser.

Likewise, the grid pattern may be produced by means of a printing method, in particular by means of pad printing, on the plate carrier. With the plate carriers always being the same, this method has the advantage that almost any kind of materials can be printed, and that a desired color of the grid pattern may be chosen freely.

Moreover, the object according to the invention is solved by a self-inking stamp having an actuating member displaceable in relation to a housing, having a plate carrier according to any of claims 1 to 4 coupled thereto. In such a self-inking stamp, a symmetrical distribution of forces during printing is mechanically forced by the coupling of the plate carrier with the actuating member, so that the advantages mentioned—above all with respect to a centering along a swivel axis of the plate carrier—are particularly brought to bear.

In the corresponding method for producing such a self-inking stamp it is favorable if the plate carrier is coupled to the actuating member arranged over the housing (only) after having been provided with the grid pattern. Accordingly, the plate carrier is provided with the grid pattern and only subsequently mounted in the self-inking stamp. This order is of advantage since the alignment of the individual plate carrier is easier and more exact than the alignment of the entire self-inking stamp or of the plate carrier that has already been coupled to the actuating member.

Figure 1C:
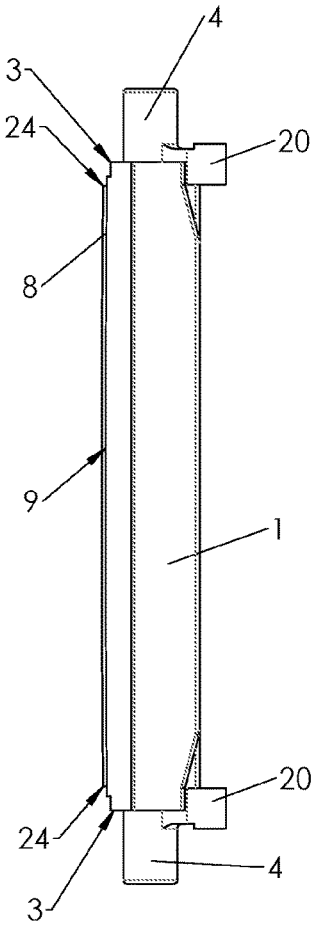
Figure 1A:
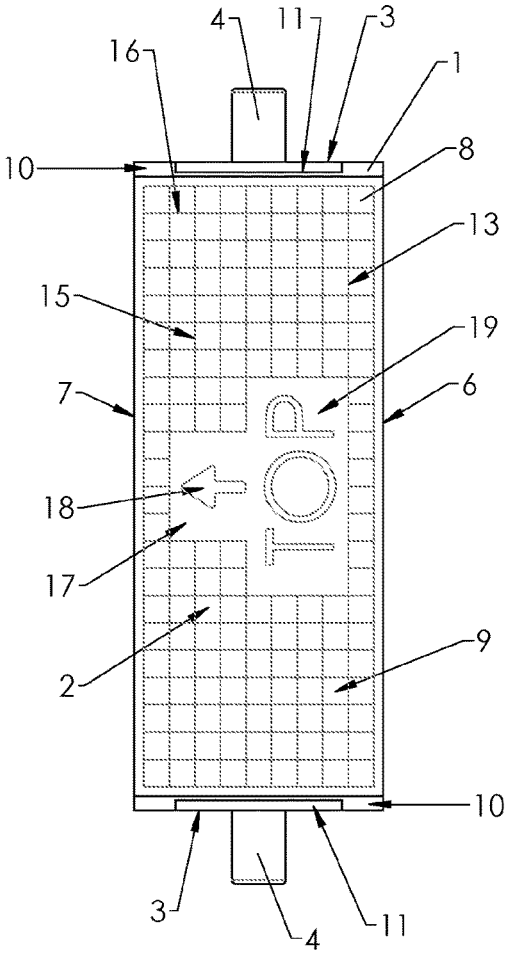
Figure 2B:
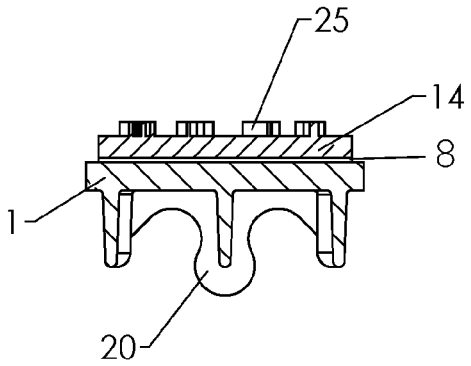
Figure 2A:
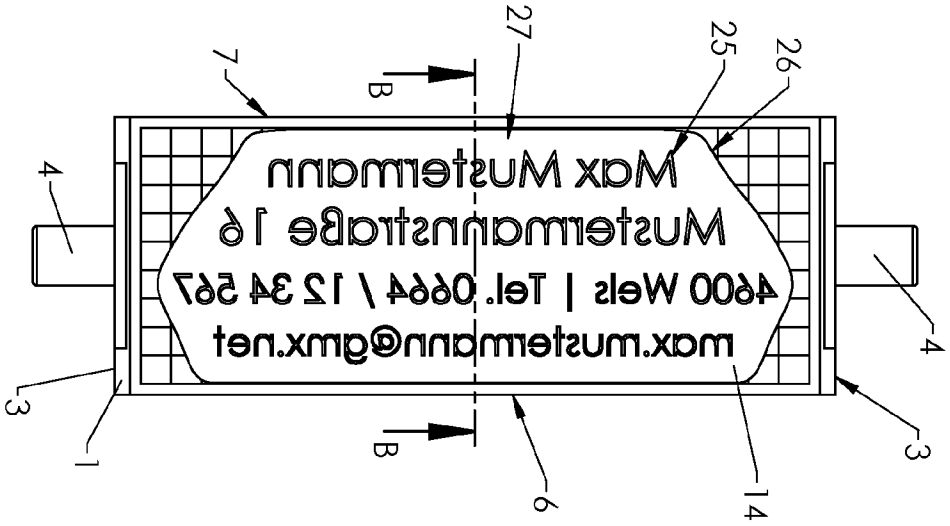
Figure 3:
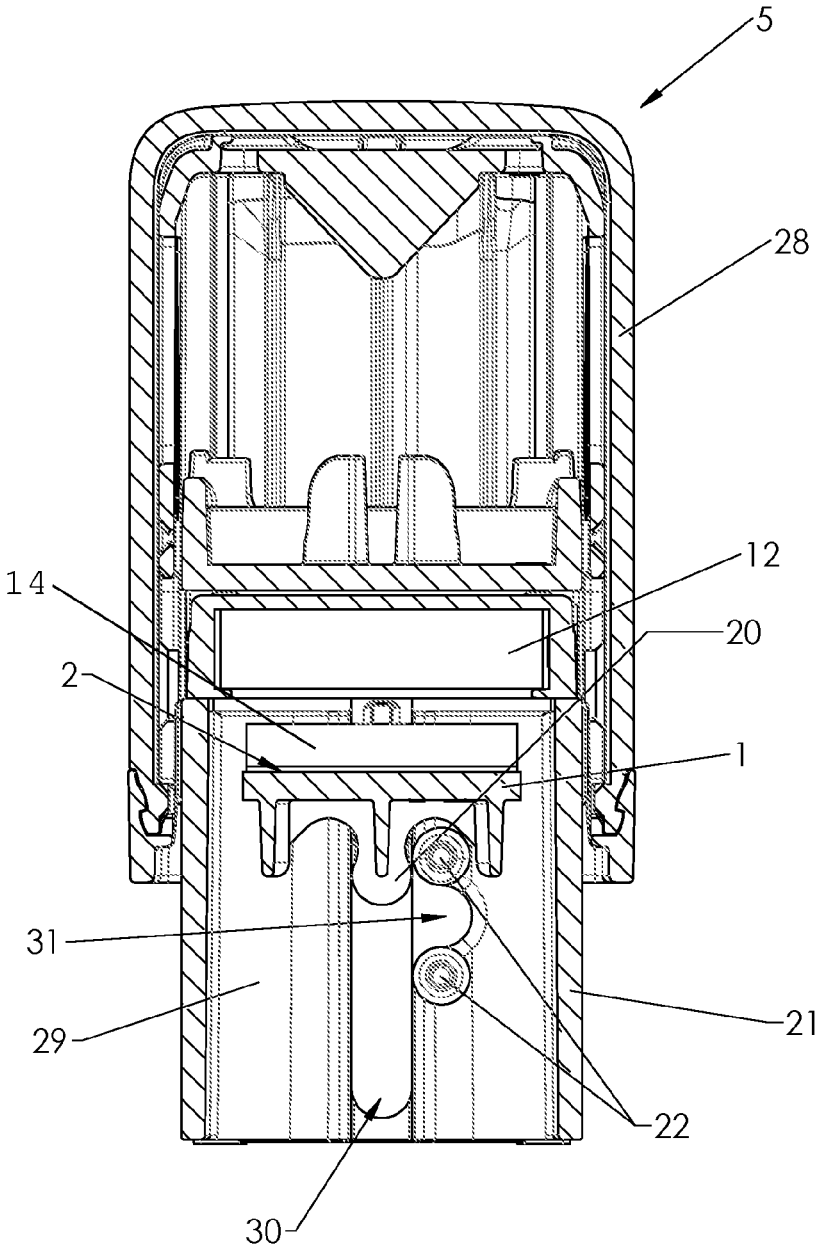

In the following, the invention will be described in more detail by means of particularly preferred embodiments, which it is not intended to be restricted to, though, and with reference to the drawings. The drawings show in detail:

FIG. 1A a plan view of a plate carrier with a grid pattern;

FIG. 1B and/or FIG. 1C a side view from the left and/or a front view of the plate carrier according to FIG. 1A;

FIG. 2A a plan view of a plate carrier according to FIGS. 1A-C with a text plate;

FIG. 2B a sectional view through the plate carrier with the text plate pursuant to FIG. 2A along the line B-B in FIG. 2A; and FIG. 3 a sectional view through a self-inking stamp with a plate carrier pursuant to FIG. 1B.

The plan view of a plate carrier 1 illustrated in FIG. 1A is directed directly to the printing side 2 thereof. The plate carrier 1 (whose arrangement in a self-inking stamp will be explained in detail in the following by means of FIG. 3) is substantially rectangular, i.e. the top view of the printing side 2 is rectangular. Beyond the two lateral (short) edges 3 of the plate carrier 1 there extends a respective pin or pivot part 4. The two pivot parts 4 define a pivot axis of the plate carrier 1 about which it is pivoted when used in a self-inking stamp 5 (cf. FIG. 3). Accordingly, the long edges 6, 7 of the plate carrier 1 are arranged in parallel to the pivot axis. A double-sided adhesive film 8 is arranged on the printing side 2 (see FIGS. 1B, 1C) and forms an adhesive surface 9 on the printing side 2 of the plate carrier 1. The double-sided adhesive film 8 covers substantially the entire printing side 2, but has a somewhat smaller longitudinal extension than the printing side 2 and is therefore slightly spaced apart from the two short lateral edges 3. In the two areas 10 of the printing side 2 which are exposed from the double-sided adhesive film 8 and which are adjacent to the shorter lateral edges 3, a respective longitudinal recess 11 is provided which facilitates the detaching of a possible cover film (not illustrated) on the double-sided adhesive film 8 or else of the double-sided adhesive film 8 itself. A cover film of the double-sided adhesive film 8 may, for instance, prevent the adhesive surface 9 from drying out, and a loss of the adhesive effect, but also unintentional coloring of the plate carrier 1 which may be disposed adjacent to an inking pad 12 in a transport or rest position (cf. FIG. 3).

Furthermore, the plate carrier 1 comprises on the printing side 2 a grid pattern 13 for aligning a text plate 14 (cf. FIG. 2A) when attaching it to the adhesive surface 9 of the plate carrier 1. Since a possible cover film may generally be non-transparent, the grid pattern 13 will possibly appear only after the cover film has been drawn off. The grid pattern 13 is aligned in relation to the edges 3, 6, 7 of the plate carrier 1, i.e. the positioning of the grid pattern 13 on the printing side 2 is exactly determined and exactly reproducible. The grid pattern 13 comprises long and short lines 15 and/or 16 which are rectangular relative to each other and which are arranged in regular distances to each other. An orientation element 17 is provided in the center of the grid pattern 13 and comprises a directional arrow 18 and a lettering 19, wherein the lines 15, 16 of the grid pattern 13 are interrupted in the region of the orientation element 17. The distance of the grid pattern 13 from the edges 3, 6, 7 is of equal size at the respectively opposing sides 3 and/or 6 and 7. The grid pattern 13 is arranged below the double-sided adhesive film 8 directly on the printing side 2 of the plate carrier 1. The double-sided adhesive film 8 is therefore at least partially transparent, so that the grid pattern 13 is recognizable during attaching of a text plate 14.

In the embodiment illustrated here, the grid pattern 13 consists exclusively of lines 15, 16, 18, 19, namely as a result of the production by laser marking. In particular, the orientation element 17 is not set apart from the printing side 2 of the plate carrier 1 over the full area, e.g. in color, but only the contours, i.e. lines, are colored or marked otherwise.

The dimensions of the orientation element 17 are preferably chosen such that that it may be covered by an average text plate which covers at least 25 percent of the adhesive surface 9. This can prevent that the alignment of a text plate is impaired by the orientation element 17—which naturally does not have the desired symmetry of the remaining grid pattern and only constitutes noticeable aid during the orientation of the text plate.

FIG. 1B illustrates the vertically offset arrangement of the pivot parts 4 in relation to the printing side 2 of the plate carrier 1. Below the pivot parts 4 the plate carrier 1 comprises a pin-shaped turning lever 20 which is adapted to be received between two pin projections 22 arranged in a housing 21 of a self-inking stamp 5 (cf. FIG. 3). Laterally of the turning lever 20 semicircular notches 23 for receiving the pin projections 22 are accordingly provided.

On the printing side 2 of the plate carrier 1, the double-sided adhesive film 8 which rises over the plate carrier 1 and extends over the entire breadth of the plate carrier 1, i.e. between the edges 6, 7, can be noticed in FIGS. 1B and 1C. The lateral recess 11 in the plate carrier 1 reaches approximately to the outer circumference of the pivot part 4.

As may be gathered from FIG. 1C, the turning levers 20 extend on both sides beyond the lateral edges 3 of the plate carrier 1, but substantially less than the respective pivot parts 4 arranged there above. Due to the double-sided adhesive film 8 which is somewhat shorter than the plate carrier 1, steps 24 to the areas 10 adjacent to the adhesive surface 9 are produced on both sides between the adhesive surface 9 and the lateral edges 3.

FIGS. 2A and 2B illustrate the plate carrier 1 pursuant to FIGS. 1A to 1C with a stamp plate and/or text plate 14 and with an adhesive film 8. The text plate 14 consists, for instance, of vulcanized rubber or a polymer. The shape of the text plate 14 is advantageously adapted to the relief and/or the printing pattern 25, i.e. the distance between the outer contour of the printing pattern 25 and the edge 26 of the text plate 14 is as small as possible. Such shape is usually achieved by cutting the text plate 14 to an approximate contour of the printing pattern 25. Due to this adaptation it is possible to avoid that, during the production of a stamp print, artifacts apart from the desired print of the printing pattern 25 which would be produced by a contact of lateral surfaces of the colored text plate 14 with the stamped surface, are also printed. Such contact may easily occur in particular in the case of a relatively low height of the printing pattern 25—which is often preferred for economic reasons. A typical dimension is, for instance, a printing pattern height of approx. 0.8 mm (for comparison: the strength of the text plate is approx. 2.3 mm). By adapting the text plate 14 to the contour of the printing pattern 25, the lateral surfaces are removed and it is thus avoided that possible artifacts are also printed.

On the other hand, in the case of text plates 14 which are cut this way it is, according to experience, more difficult to achieve a correct alignment and centering on a plate carrier than with rectangular text plates. However, if—as in the instant embodiment—a grid pattern 13 is provided on the plate carrier 1, it is easy to handle the alignment and centering even in the case of text plates 14 deviating from the rectangular shape. In particular, even with edges 26 of the text plate 14 which are slanted in relation to the edges 3, 6, 7 of the plate carrier 1, the grid pattern 13 offers optical reference points for the correct alignment and for centering, wherein it is of advantage if the cut of the text plate 14 is mirror-symmetrical. The distances of the text plate 14 from the edges 3, 6, 7 of the plate carrier 1 may, for instance, be estimated by counting the markings of the grid pattern 13 on all sides of the text plate 14, so that—if desired—about equal and/or symmetrical distances can be achieved. The correct alignment of the text plate 14, i.e. the arrangement of the upper edge 27 of the text plate 14 defined by the orientation of the lettering, in relation to the plate carrier 1 may be determined easily by means of the orientation elements 17 of the grid pattern 13 prior to attaching.

FIG. 3 illustrates by way of example a self-inking stamp 5 with a housing 21 and an actuating member and/or actuating bracket 28 which is mounted to be displaced in relation to the housing 21. An ink pad 12 and a plate carrier 1 are arranged in the housing 21. The plate carrier 1 is pivotably coupled to the actuating bracket 28 and thus—like the actuating bracket 28 itself—mounted to be displaced in relation to the housing 21. The plate carrier 1 is here illustrated without text plate 14, so that the printing side 2 of the plate carrier 1 is spaced apart from the ink pad 12 in the illustrated rest position. A text plate 14 which is in contact with the ink pad 12 and is colored by same is arranged on the printing side 2 of the plate carrier 1. The two side walls 29 of the housing 21 each comprise a vertical guide slot 30 which receives the pivot parts 4 of the plate carrier 1. Next to each slot 30, at the inner side of the side wall 29 of the housing, below the plate carrier 1, the above-mentioned two pin projections 22 are arranged one below the other and form a recess 31 for receiving the turning lever 20 of the plate carrier 1 in between. The two guide slots 30 in which the pivot parts 4 of the plate carrier 1 are received without horizontal play determine the alignment of the plate carrier 1 in the horizontal plane in the housing 21 unambiguously and exactly. The user of the stamp 5 can therefore achieve an exact alignment of the print by aligning the housing 21 on a surface to be stamped, since the plate carrier 1 is exactly aligned in relation to the housing 21 by means of the pivot parts 4 and the text plate is exactly aligned in relation to the plate carrier 1 by means of the grid pattern 13.

The invention claimed is:

1. A plate carrier for a self-inking stamp, the plate carrier comprising:

an adhesive surface for attaching a text plate to a printing side of the plate carrier;

a grid pattern provided on the printing side and aligned in relation to edges of the plate carrier for aligning the text plate when attaching the text plate to the plate carrier; and an orientation element provided on the printing side and aligned in relation to the edges of the plate carrier for indicating a preferred direction of orientation of the text plate with respect to the plate carrier, wherein the adhesive surface is formed by a transparent double-sided adhesive film covering the grid pattern.

2. A self-inking stamp comprising an actuating member displaceable relative to a housing, having a plate carrier according to claim 1 coupled thereto.

3. A method for producing a plate carrier having an adhesive surface for attaching a text plate to a printing side of the plate carrier, the method comprising:

printing, laser marking, engraving or shaping a grid pattern on the printing side of the plate carrier and in alignment with edges of the plate carrier, said grid pattern dividing the adhesive surface into a series of contiguous cells; and before printing, laser marking, engraving or shaping the grid pattern on the printing side of the plate carrier, connecting a double-sided adhesive film with the printing side of the plate carrier.

4. The method according to claim 3, wherein the grid pattern is produced with a ND:YAG laser on the plate carrier.

5. The method according to claim 3, wherein the grid pattern is produced by means of pad printing on the plate carrier.

6. A method for producing a self-inking stamp having an actuating member displaceable relative to a housing and mounted over the housing, the method comprising:

producing a plate carrier having an adhesive surface for attaching a text plate to a printing side of the plate carrier by printing, laser marking, engraving or shaping a grid pattern on the printing side of the plate carrier and in alignment with edges of the plate carrier, said grid pattern dividing the adhesive surface into a series of contiguous cells; and thereafter coupling the plate carrier with the actuating member.

7. A plate carrier for a self-inking stamp, the plate carrier comprising:

an adhesive surface for attaching a text plate to a printing side of the plate carrier;

a grid pattern provided on the printing side and aligned in relation to edges of the plate carrier for aligning the text plate when attaching the text plate to the plate carrier; and an orientation element provided on the printing side separate from the grid pattern and aligned in relation to the edges of the plate carrier and comprising at least one of a directional arrow and a lettering for indicating a preferred orientation of the text plate with respect to the plate carrier, wherein the adhesive surface is formed by a transparent double-sided adhesive film covering the grid pattern.

8. A self-inking stamp comprising an actuating member displaceable relative to a housing, having a plate carrier according to claim 7 coupled thereto.

* * * * *